United States Patent [19]

Dockins, Jr.

[11] 4,315,542

[45] Feb. 16, 1982

[54] MECHANICAL TUBING DRAIN

[76] Inventor: Roy R. Dockins, Jr., 1906 Ninth St., Anaheim, Calif. 92802

[21] Appl. No.: 88,364

[22] Filed: Oct. 26, 1979

[51] Int. Cl.[3] ..... E21B 33/129; E21B 34/12

[52] U.S. Cl. ..... 166/117.7; 166/330; 166/331

[58] Field of Search ..... 166/330, 331, 214, 215, 166/117.7; 251/309, 317, 352

[56] References Cited

U.S. PATENT DOCUMENTS

| | | | |
|---|---|---|---|
| 1,896,111 | 2/1933 | Simmons | 166/330 X |
| 1,968,391 | 7/1934 | Hamilton | 251/352 X |
| 2,270,952 | 1/1942 | Lee | 166/330 X |
| 2,360,311 | 10/1944 | Ausburn et al. | 166/331 X |
| 2,711,302 | 6/1955 | McWhorter | 251/317 X |
| 2,858,099 | 10/1958 | Althouse, Jr. et al. | 166/330 X |
| 3,380,706 | 4/1968 | Scaramucci | 251/317 X |
| 3,971,402 | 7/1976 | Gallo | 251/309 X |
| 3,993,130 | 11/1976 | Papp | 166/330 |

FOREIGN PATENT DOCUMENTS

| | | | |
|---|---|---|---|
| 1531474 | 11/1978 | United Kingdom | 251/309 |

*Primary Examiner*—James A. Leppink
*Assistant Examiner*—George A. Suchfield

[57] ABSTRACT

A mechanical tubing drain connected in a tubing string in an oil well. The invention, which provides means for selectively opening and closing drain ports to drain fluid from a tubing string, comprises a ported mandrel slidably encased in a correspondingly ported sleeve. Seal means are provided about the mandrel port. Means are also provided to maintain proper longitudinal alignment between the mandrel and sleeve ports as well as guiding and restricting the movement of the sleeve about the mandrel. Spring loaded shoes attached to the sleeve engage the well casing to hold the sleeve immobile relative to the ported mandrel. In operation, the mandrel is rotated to selectively align the mandrel and sleeve ports to permit unloading of the tubing contents.

8 Claims, 5 Drawing Figures

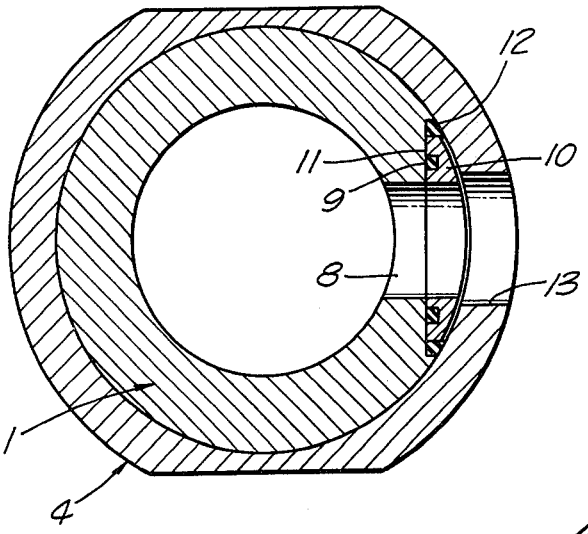
FIG. 3.
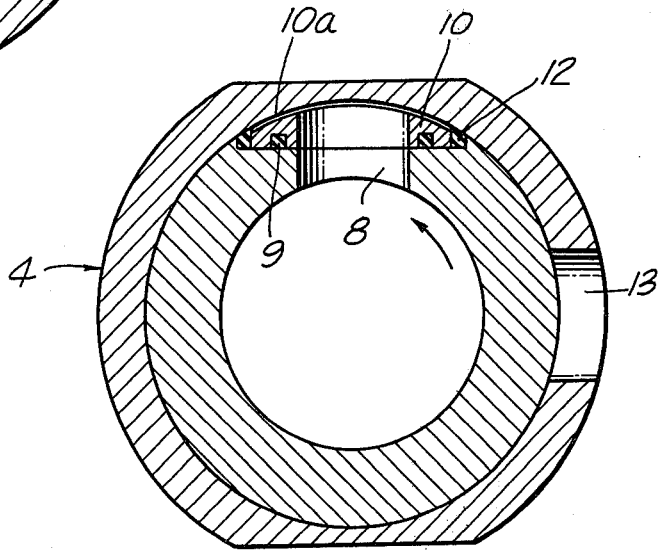
FIG. 4.
FIG. 5.
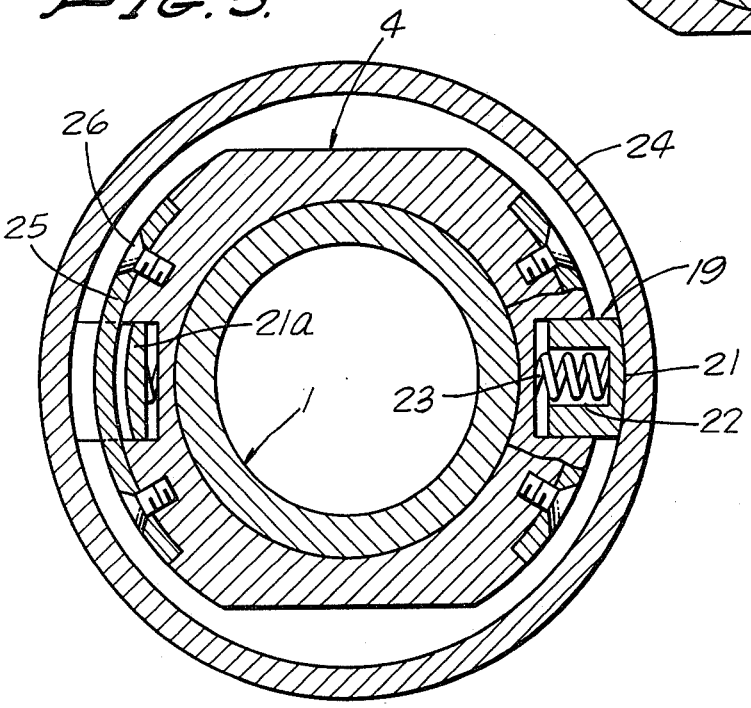

MECHANICAL TUBING DRAIN

BACKGROUND

The field of this invention relates to sucker rod pumping wells. When the tubing string of such wells is being pulled for inspection, repair or replacement, fluid contained within the tubing is raised and as each section of the tubing string is disconnected, the fluid spills out creating a working and fire hazard. Means can be provided at the well head to capture the fluid as each section of tubing is pulled, however, this operation is tedious and materially slows the pulling of the tubing string.

Prior inventions have attempted to circumvent this problem, but have been only partially successful due to a variety of drawbacks. One problem has been providing adequate flow area, particularly if the fluid is highly viscous. One line of inventions, of which Marathe, U.S.-Pat. No. 3,981,360 is representative, utilized a piston sleeve which was activated by hydraulic pressure to shear a retainer pin thereby opening the tubing ports. The drawback of this invention is that there is no way of closing the port once opened without pulling the entire tubing string and replacing the shear pins. Lewis, U.S. Pat. No. 3,610,337, attempted to solve this problem by means of telescoping members disposed in the tubing string which could be selectively raised or lowered to open or close outlet ports. The main drawback of this invention was its complexity of operation, requiring both a pulling and rotating movement to open the ports and move a spring loaded dog along a complicated path to hold the apparatus in either the open or closed position. Moreover, the portion of the tubing string below the apparatus had to be securely anchored before the apparatus was operable. Thus, a tubing anchor resistive to both rotational and vertical forces was required.

The present invention solves these problems by providing mechanical means to selectively open and close the drain ports. The mechanical means involves a simple rotational movement of the tubing string, the sleeve being held immobile against the well casing, but no anchoring with respect to vertical forces is necessary, and in fact the present device may be moved vertically in the casing without appreciable resistance.

SUMMARY

The mechanical tubing drain is threadably connected in the tubing string of a pumping well. The invention, which provides means for selectively opening and closing drain ports to drain fluid from the tubing string, comprises a ported mandrel encased in a correspondingly ported sleeve. Seal means are provided about the mandrel port. Means are also provided to maintain proper longitudinal alignment between the mandrel and sleeve ports as well as guiding and restricting the concentric movement of the sleeve about the mandrel. Once the invention is disposed within the well casing, spring loaded shoes attached to the sleeve engage the well casing to hold the sleeve immobile relative to the ported mandrel. In operation, the mandrel is rotated about 90° to selectively align the mandrel and sleeve ports to allow for unloading of the tubing contents.

It is, therefore, the primary object of this invention to provide a mechanically activated tubing drain.

It is a particular object of this invention to provide a tubing drain which may be selectively and repeatedly opened and closed without pulling the tubing string from the well.

Another object of this invention is to provide a tubing drain which accomplishes the above two objects by means of a simple, rugged, easy to operate design which does not require the use of additional tubing anchors or hangers.

It is also an object of this invention to provide a selectively operable tubing drain having an adequate aperture size for the drain port to pass viscous fluids yet which can be effectively sealed when closed.

Other and further objects, features and advantages will be apparent to those skilled in the art from the following description of the presently preferred embodiment and the claims.

DESCRIPTION OF THE DRAWINGS

FIG. 3 is a cross-section of the invention taken along line 3—3 in FIG. 1 showing the invention in the open position with the mandrel and sleeve ports in alignment.

FIG. 4 is a cross-section of the invention, at the same location as FIG. 3, showing it in the closed position with the mandrel and sleeve ports out of alignment.

FIG. 5 is a cross-section of the invention, taken along line 4—4 in FIG. 1, showing the spring loaded shoes which engage the well casing.

DETAILED DESCRIPTION

Figure 1:
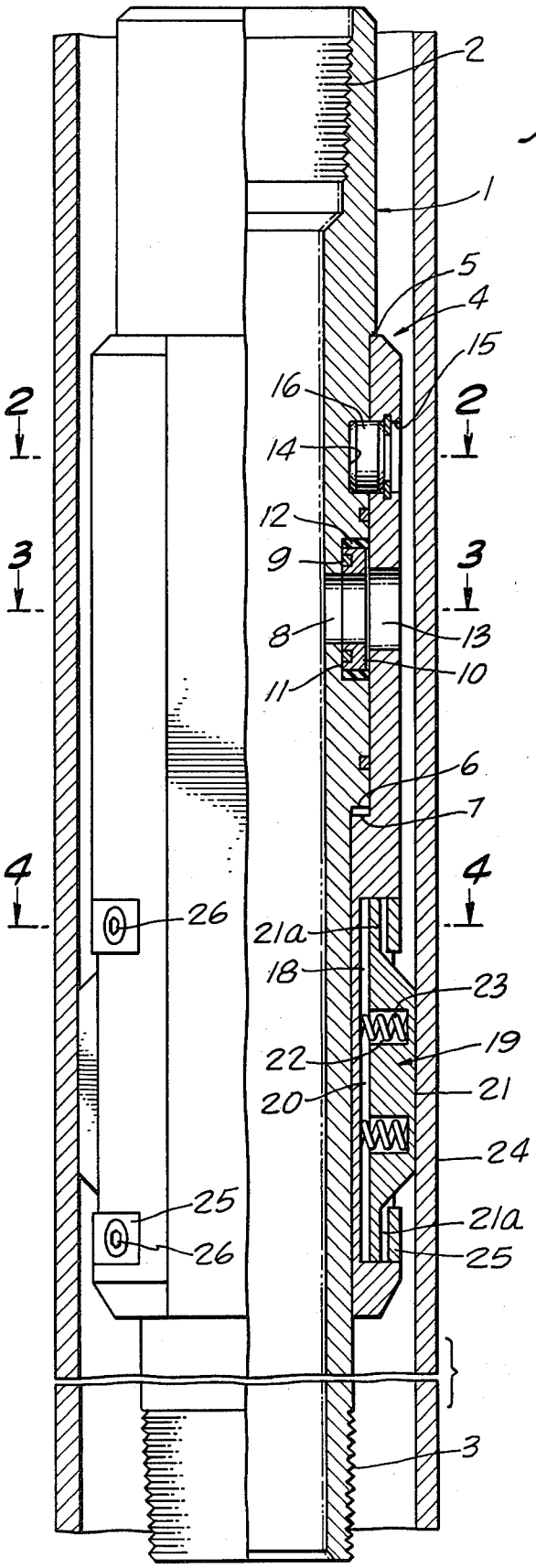
FIG. 1 is a sideview of the well tubing drain as it appears in a well casing to be connected into a tubing string.

The invention is designed to be threadably interposed in the tubing string. To this end, the mandrel 1 is fitted with threads 2 at its upper end, and threads 3 at its lower end. Sleeve 4 encompasses the mandrel 1 and is mounted thereon in a manner to permit limited rotational movement between them. The upper end of sleeve 4 abuts shoulder 5 on mandrel 1 thereby limiting upward movement of the sleeve relative to the mandrel. Near the longitudinal center of sleeve 4, the exterior diameter of mandrel 1 is again reduced to form second shoulder 6. Correspondingly, the interior diameter of sleeve 4 is equally reduced to form shoulder 7. Shoulder 5 maintains the sleeve 4 in proper position during insertion of the tubing string into the well casing and limits upward movement of the sleeve on the mandrel. The shoulders 6 and 7 may do likewise; however, their principal purpose is a change in the relative wall thickness of the sleeve and the mandrel for purposes which will become clear.

Figure 2:
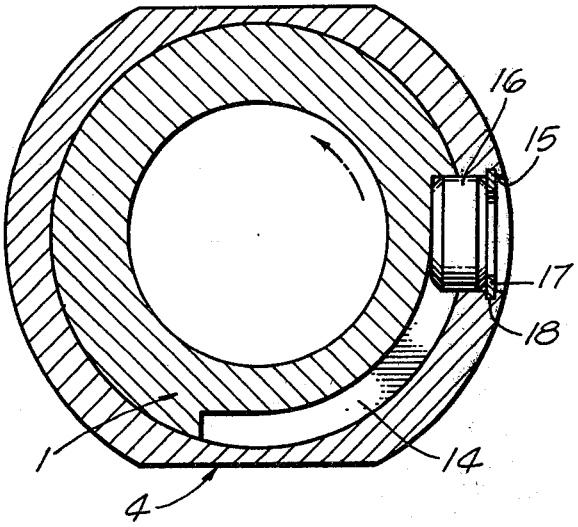
FIG. 2 is a cross-section of the invention taken along line 2—2 of FIG. 1 showing the means for guiding and restraining movement of the sleeve relative to the mandrel.

Mandrel 1 is fitted with one or more lateral drain ports 8 which extend through the mandrel wall. Sleeve port 13 extends through sleeve 4 and is longitudinally aligned with mandrel port 8. To guide and restrict the rotational movement of mandrel 1 within sleeve 4, an arcuate groove 14 is provided in mandrel 1 near the upper portion of the sleeve, (See FIG. 2). This groove extends through an arc of about 90°. Aligned with groove 14, circular aperture 15 extends through sleeve 4. Circular button 16 is inserted through aperture 15 into and engaging groove 14. Button 16 is held in place by any suitable means such as a snap ring 17 positioned in groove 18. Groove 18 is formed about the interior circumference of aperture 15. Button 16 therefore acts as a guide and restraining member during the rotational movement of mandrel 1 within sleeve 4 and, at the same time, vertically supports the sleeve on the mandrel, resisting downward movement, thereby maintaining, with shoulder 5, longitudinal alignment between mandrel port 8 and sleeve port 13.

Referring now to FIGS. 1, 3 and 4, the sealing ring 10 will be seen residing in a recess 11 surrounding drain port 8. Ring 10 is of rigid material such as steel, as are the sleeve and mandrel to resist frictional deterioration, as it is well known that oil wells contain many abrasive substances which readily damage more resilient or softer materials. The seal ring 10 is surrounded by an outer resilient washer 12 situated in the recess 11 and in sealing contact with the inner surface of sleeve 4. Ring 10 is also provided with an O-ring 9 which forms a sealing contact between ring 10 and the bottom of recess 11. Reference to FIGS. 3 and 4 discloses that the width of ring 10 is less than the depth of recess 11. This is done so that movement of the sleeve relative to the mandrel does not result in abrasive sliding friction on ring 10. The space 10*a* between ring 10 and sleeve 4 also permits ring 10 to seal port 8 effectively against leakage when in the closed position. Reference to FIG. 4 discloses that fluid pressure in port 8 will be exerted in space 10*a* thereby exerting pressure between the sleeve and the outer surface of ring 10. Fluid pressure will also be exerted on the underside of ring 10 but O-ring 9 limits the surface area of the ring exposed to fluid pressure to the area within the O-ring. As a result fluid pressure on the outer surface of the ring 10 is considerably greater than on the inside such that ring 10 is forced inward. This of course maintains space 10*a* which in turn avoids frictional deterioration or binding of the ring against the sleeve when the drain is actuated. Thus an effective port seal is obtained with a longer operational life expectancy.

As previously noted, at shoulders 6 and 7, the respective wall thicknesses change. As this juncture, the mandrel has the greater wall thickness so as to accommodate the seal ring 10 and the groove 14. Below this juncture, the wall thickness of sleeve 4 is greater. Here, a number of recesses 18 are provided to receive shoes 19 and their related appurtenances. In this embodiment, shoe 19 is long and narrow, its rear surface 20 is flat and its engaging surface 21 tapers at each end to uniform narrow flanges 21*a*. Circular cavities 22 are formed in the rear of brake shoe 19 to receive springs 23. The springs bias the shoes against well casing 24. Straps 25 extend over the narrow flanges 21*a* to retain the shoes 19 within the recesses. Straps 25 are attached to the sleeve 4 by means of fasteners 26.

The means by which the sleeve 4 is held immobile against the well casing may be better appreciated by reference to FIG. 5. FIG. 5, in cross-section, shows the relationship between mandrel 1, sleeve 4 and well casing 24. The brake shoes 19 reside within recesses 18 in outer sleeve 4. Springs 23 bias the shoes 19 against the well casing 24. FIG. 5 clearly shows that the straps 25 and the fasteners 26 are recessed into appropriately sized recesses in sleeve 4 such that the smooth exterior of sleeve 4 is maintained. FIG. 5 also shows that opposing exterior sides of sleeve 4 have been cut to provide for freedom of movement of fluids within the well casing 24 passed the tool of this invention.

To operate the invention after it has been disposed in the well bore, the tubing string into which mandrel 1 has been incorporated is simply rotated relative to sleeve 4. Sleeve 4 is held immobile against rotation by the plurality of shoes 19 which engage in casing well 24, but shoes 19 do not restrict longitudinal sliding movement of the tubing in the well casing. To close the drain ports, the tubing string is rotated 90° in an opposite direction.

I claim:

1. A drain for a well tubing string, comprising:

a tubular mandrel having at least one lateral port and adapted to be interposed between sections of a tubing string:

a sleeve member surrounding said mandrel and rotationally movable thereon, said sleeve having at least one lateral port;

sealing means disposed about the lateral mandrel port sealing engaging said sleeve, said means comprising an enlarged annular recess in said mandrel surrounding said mandrel port, a sealing ring situated in said recess, said ring having a width less than the depth of said recess providing a gap between the outer surface of said ring and the inner surface of said sleeve, a washer ring surrounding said sealing ring in sealing contact with said sleeve, and an O-ring of lesser diameter than said washer ring, said O-ring situated between said sealing ring and the bottom surface of said recess;

support means for maintaining said mandrel port and said sleeve port in longitudinal alignment;

guide means for controlling rotational movement of said sleeve with respect to said mandrel;

stop means on said sleeve for engaging the casing wall of an oil well, said means operative to limit rotation of said sleeve when said tubing string is rotated.

2. A drain for a tubing string as defined in claim 1, wherein said guide means comprises:

a groove formed in the periphery of said mandrel, an aperture in said sleeve, and a button extending through said aperture into said groove, said groove extending approximately one quarter of the circumference of said mandrel.

3. A drain for a tubing string as defined in claim 1, wherein said support means and said guide means comprises:

a groove formed in the periphery of said mandrel and extending about one quarter of its circumference, an aperture in said sleeve, and a button extending through said aperture and into said groove, an edge of said groove bearing upon the upper edge of said button for vertical support of said sleeve, said button being slidable in said groove upon rotation of said mandrel to position the ports in a closed or an open condition.

4. A drain for a tubing string of the type described in claim 1, wherein said stop means comprises a plurality of shoes resiliently mounted on said sleeve and projecting outwardly therefrom, said shoes being of elongate generally rectangular configuration, the longitudinal dimension being aligned generally parallel to the length of the tubing string.

5. A drain for a well tubing string comprising:

a tubular mandrel having at least one lateral port and adapted to be interposed between sections of a tubing string;

a sleeve member surrounding said mandrel and rotationally movable thereon, said sleeve having at least one lateral port;

sealing means for said mandrel port comprising an annular recess in said mandrel surrounding said mandrel port, a sealing ring situated in said recess, said sealing ring having a width less than the depth of said recess defining a gap between the outer surface thereof and the inner surface of said sleeve, a washer ring surrounding said sealing ring and in sealing contact with said sleeve, and an O-ring situated between said sealing ring and the bottom surface of said recess;

said mandrel further provided with a groove formed in the periphery thereof and extending about one quarter of its circumference, a corresponding aperture in said sleeve and a button extending through said aperture and into said groove, an edge of said groove bearing upon the upper portion of said button for vertical support of said sleeve with respect to said mandrel, said button being slidable in said groove in response to rotation of said mandrel to position the mandrel port in a closed condition or in register with said sleeve port; and stop means resiliently mounted upon said sleeve and extending outwardly therefrom to engage the casing wall of an oil well, said means comprising a plurality of resiliently mounted shoes, said shoes being of an elongate generally rectangular configuration, the longitudinal dimension being aligned generally parallel to the length of the tubing string, said means operative to limit rotation of said sleeve when said tubing string is rotated.

6. A drain for a well tubing string, comprising:

a tubular mandrel having at least one lateral port and adapted to be interposed between sections of a tubing string;

a sleeve member surrounding said mandrel and rotationally movable thereon, said sleeve having at least one lateral port;

sealing means for said mandrel port comprising an annular recess in said mandrel surrounding said mandrel port, a sealing ring situated in said recess about said mandrel port, said sealing ring having a width less than the depth of said recess, and a washer ring surrounding said sealing ring within said recess, said washer ring in sealing contact with said sleeve;

an annular groove in the periphery of said mandrel and an aperture in said sleeve, said aperture longitudinally aligned with said groove;

a button extending through said aperture into said groove and slidable in said groove for guiding and restraining rotational movement of said mandrel relative to said sleeve; and stop means resiliently mounted upon said sleeve to engage the casing wall of an oil well for limiting the rotational movement of said sleeve, without limiting the longitudinal movement of said sleeve.

7. A drain for a tubing string as defined in claim 6 further comprising an O-ring of lesser diameter than said washer ring, said O-ring situated between said sealing ring and the bottom surface of said recess.

8. A drain for a tubing string as defined in claim 7 wherein said stop means comprises a plurality of spring biased shoes attached to said sleeve and extending outwardly therefrom.

* * * * *